United States Patent [19]

Sellars

[11] Patent Number: 4,563,919

[45] Date of Patent: Jan. 14, 1986

[54] CAN OPENER FOR FLIP TOP CANS

[76] Inventor: William H. Sellars, 1618 Manzanita Dr., Belmont, Calif. 94002

[21] Appl. No.: 668,558

[22] Filed: Nov. 5, 1984

[51] Int. Cl.[4] ..... B67B 7/40

[52] U.S. Cl. ..... 81/3.55; D8/18; D8/40

[58] Field of Search ..... 81/3.07, 3.4, 3.55, 81/3.57, 3.09; D8/18, 33, 40; 220/274

[56] References Cited

U.S. PATENT DOCUMENTS

| | | | |
|---|---|---|---|
| D. 42,601 | 6/1912 | Ferrall et al. | D8/18 |
| D. 263,551 | 3/1982 | Dale | D8/40 |
| D. 270,807 | 10/1983 | Dilliner | D8/18 |
| 4,133,228 | 1/1979 | DePooter | 81/3.09 |
| 4,253,352 | 3/1981 | O'Neal | 81/3.55 |
| 4,416,171 | 11/1983 | Chmela et al. | 81/3.55 |
| 4,455,894 | 6/1984 | Roberts | 81/3.55 |
| 4,455,895 | 6/1984 | Christensen | 81/3.55 |
| 4,474,087 | 10/1984 | Widman | 81/3.55 |

*Primary Examiner*—Roscoe V. Parker

*Attorney, Agent, or Firm*—Limbach, Limbach & Sutton

[57] ABSTRACT

A tool for opening beverage cans of the type having a flip-top structure with a ring and displaceable disc is described. The tool has an elongated handle with one end thereof including a blade with a sharp edge, said blade extending past the handle's end. At the end of the handle adjacent the blade, two downwardly projecting rails cooperate to form a channel to guide the blade to its ultimate position in the process of opening a beverage can with a flip top structure.

11 Claims, 12 Drawing Figures

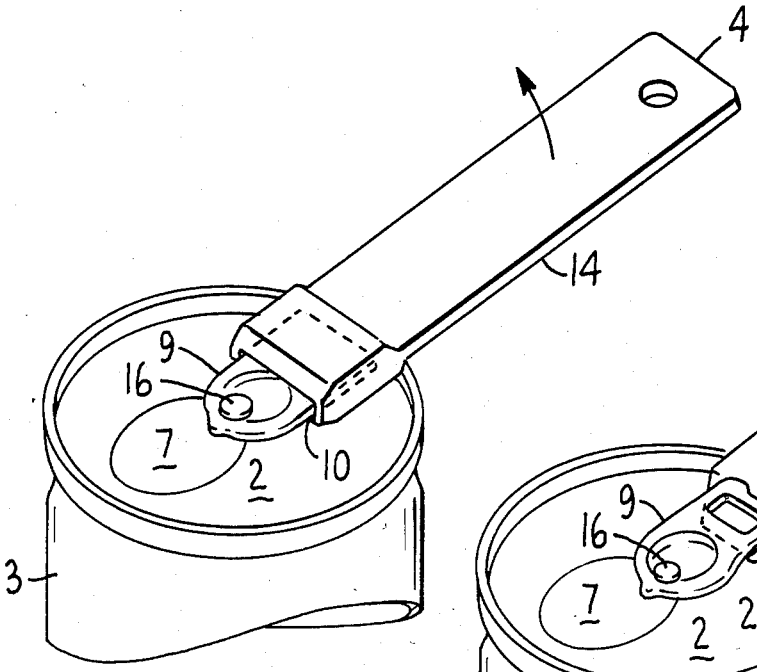
PRIOR ART
FIG. 1.
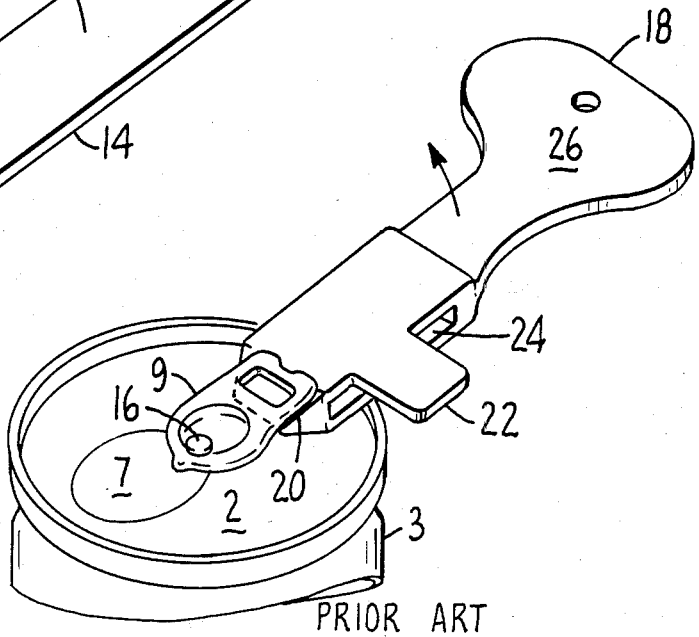
PRIOR ART
FIG. 2.
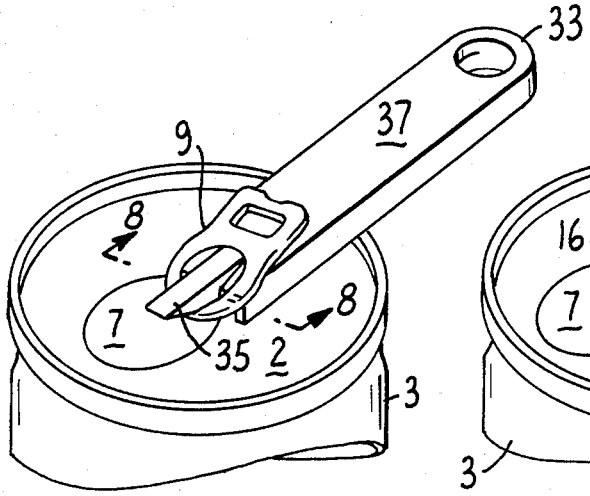
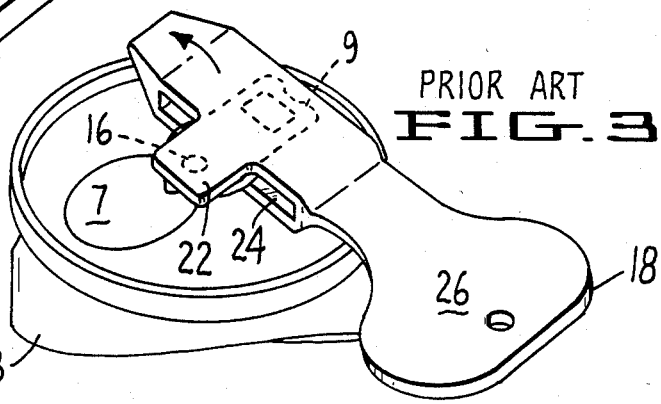
PRIOR ART
FIG. 3.
FIG. 4.
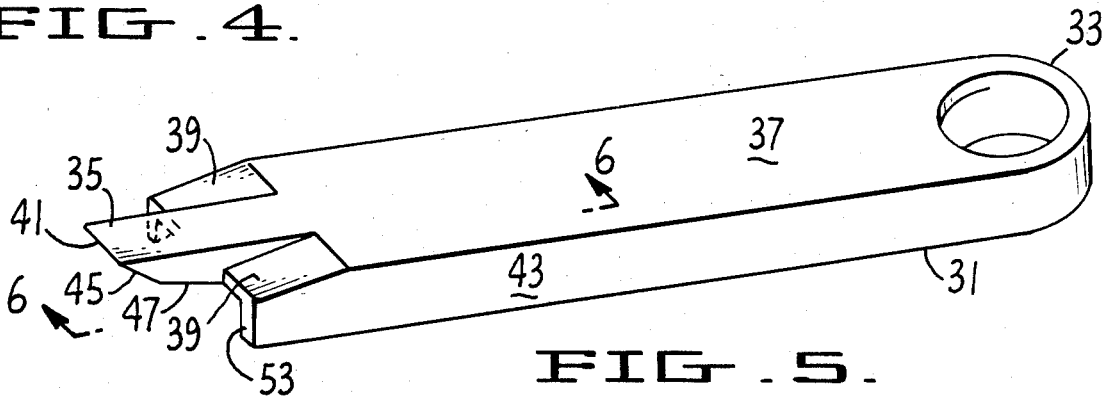
FIG. 5.

CAN OPENER FOR FLIP TOP CANS

DESCRIPTION

1. Technical Field

This invention relates to a tool to be used in opening flip-top beverage cans. In use, the tool is slid under the ring of a flip-top structure, rotated up and away from the can surface thereby pushing the displaceable disc of the flip-top structure into the beverage can.

2. Background of the Invention

The subject invention relates to an opener for flip-top beverage cans which have a flip top ring and a displaceable disc. The ring is connected to the upper surface of the can by a raised connection proximate the displaceable disk. The most common problem encountered in opening the beverage cans is that the flip-top ring separates from the connection and leaves no means for forcing the displaceable disc downward. The difficulty of opening these cans and the often resulting cuts and broken fingernails have given rise to several tools which are intended to facilitate the opening of the cans. The inventions of the prior art will be discussed with reference to FIGS. 1, 2 and 3.

One prior art device, marketed as the Can Tab, is shown in FIG. 1. The Can Tab 4 consists of a handle 14 and a slot 10 at one end. In operation of the Can Tab 4 the flip-top ring 9 is inserted into the slot 10 and then the handle 14 is upwardly rotated so that the ring 9 is moved up and away from the upper can surface 2. This forces the displaceable disc 7 into the can. One of the difficulties with the Can Tab 4 is that the flip-top ring 9 can still separate from the raised connection 16. As a result, the beverage can cannot be opened and must be set aside until another means to open it can be found.

Another prior art device is marketed under the trademark Quick Key Tab Top Can Opener. This device is shown in FIGS. 2 and 3. Referring to FIG. 2, the Quick Key 18 has a handle 26, a slot 24, a tab 22 positioned directly above the slot 24, and a beveled end 20. This device operates in a two step process. The first step is to hold the Quick Key 18 by the handle 26 and force its beveled end 20 underneath the flip top ring 9. This step causes the ring 9 to be raised above the surface of the beverage can 2. The flip-top ring 9 is now in position for the second step which is shown in FIG. 3. The Quick Key 18 is rotated 90° from its original position as shown in FIG. 2. The flip-top ring 9 may then be inserted into the slot 24. The Quick Key 18 is then rotated by means of the handle 26 such that the tab 22 is forced downward into the displaceable disc 7 thereby forcing the displaceable disc 7 downward into the beverage can 3. By using the tab 22 some of the stress on the raised connection 16 is removed averting one of the most prevalent shortcomings of the prior art.

The Quick Key has its own shortcomings. The fact that it requires two steps to operate reduces its consumer appeal. Consumer appeal is further reduced by the size of the Quick Key.

The instant invention resolves many shortcomings of the prior art. The design of the tool permits operation in a simple, one step process. The tool is also small and pocket sized increasing its attractiveness to consumers. Finally the tool of the instant invention is easy to manufacture.

Therefore, it is an object of this invention to provide tool capable of use in a single step.

It is a further object of this invention to provide a tool which is small and pocket sized.

It is further an object of this invention to provide a tool easy to manufacture.

SUMMARY OF THE INVENTION

The tool of the instant invention provides an elongated handle at one end of which there is a blade. On that same end of the handle, there are two downwardly projecting rails which form a channel. In use, the blade is inserted under the flip top ring. The channel guides the blade over the raised connection of the flip top ring to the beverage can surface. As the flip top ring is forced up and away from the beverage can surface the blade is positioned over the displaceable disc. When the tool is rotated upwardly and away from the surface of the can, one end of said handle lifts the ring while the blade is simultaneously forced downward into the displaceable disc, causing the disc to be forced into the can.

BRIEF DESCRIPTION OF THE DRAWINGS

FIG. 1 is a perspective view of one prior art device.

FIG. 2 is one perspective view of a second prior art device in use.

FIG. 3 is another perspective view of the second prior art device in use.

FIG. 4 is a perspective view of the new and improved tool of the instant invention in use.

FIG. 5 is a perspective view of the tool of the instant invention.

DETAILED DESCRIPTION OF THE INVENTION

Figure 10:
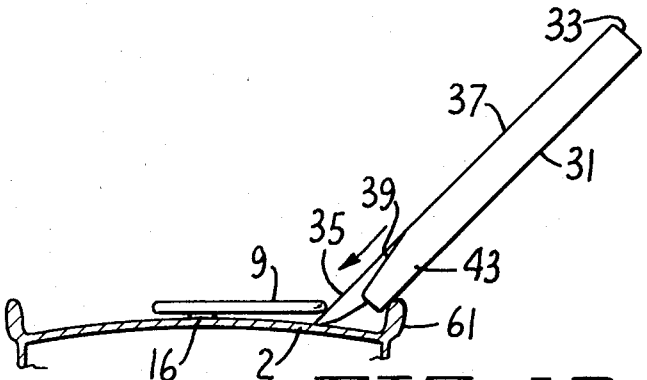
FIG. 10 is a perspective view of the tool of this invention in use.

This particularly preferred embodiment of the invention will be described with reference to FIGS. 5, 6, 7 and 9. The operation of the embodiment is described in detail with reference to FIGS. 4, 8, 10, 11 and 12.

The basic components of the tool 31 are shown in FIG. 5. The handle 37 has one rounded end 33. The other end is formed into a blade 35. The blade 35 extends past the end of the handle 37 approximately three-eights of an inch and is flanked by two chamfered surfaces 39. The blade 35 has a sharp edge 41 which is perpendicular to the long axis 6—6 of the handle 37. The upper surface of the handle 37 is positioned above two parallel, downwardly projecting rails 43 which cooperate to form a channel. In this particularly preferred embodiment, the rails 43 run the entire length of the handle 37 and act to guide the tool 31 to the preferred position for use as discussed below.

Figure 6:
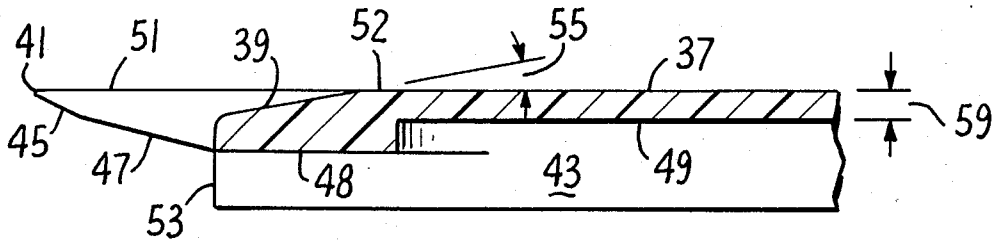
FIG. 6 is a partial cross-sectional view taken along the line 6—6 in FIG. 5.
Figure 7:
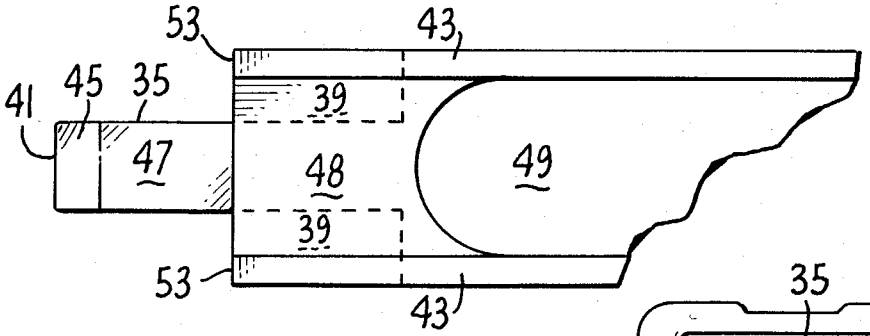
FIG. 7 is a partial bottom view of the tool of the instant invention.
Figure 9:
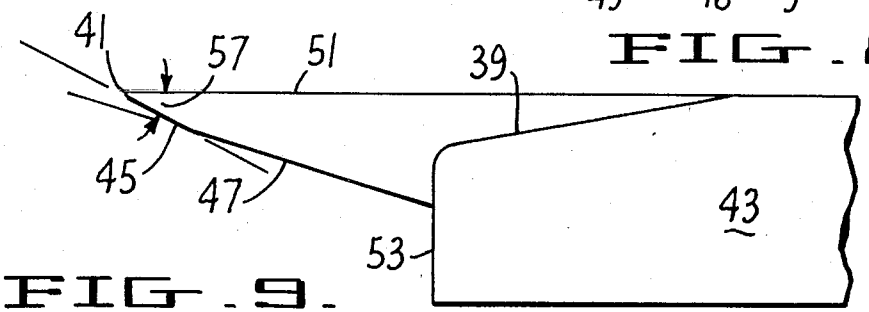
FIG. 9 is a partial side view of the tool of the instant invention.

The blade and the chamfered surfaces are shown in FIGS. 6, 7 and 9. The upper surface of the blade 51 is coplanar with the upper surface of the handle 37 as shown in FIG. 6. The lower surface of the blade 47 intersects the end of the handle 53 to form the upper boundary 48 shown in FIG. 6 of the channel 49 shown in FIG. 7. The lower surface of the blade 47 is obliquely positioned with respect to the upper surface of the blade 51 to form the sharp edge 41 shown in FIGS. 6, 7 and 9. In this embodiment, the sharpness of the edge 41 is reduced by the interpositioned surface 45 which enables the angle 57 to be less acute. In addition to the safety aspects of a less sharp edge, this smaller lower surface 45 also distributes the force of rotation over a wider area than would a more sharpened edge.

The upper surface of the handle 37 has two chamfered surfaces 39 located on either side of the blade 35. These surfaces 39 are inclined to the horizontal upper surface of the handle at an angle 55 of ten degrees, as illustrated in FIG. 6. In this particular embodiment, the chamfered surfaces 39 extend back along the length of the handle substantially the same length as the blade 35 projects past the handle's end 53. The mold used to produce this embodiment provides extra strength at this end of the handle 37 as shown in FIG. 7. As noted above, the lower surface of the blade 47 meets the handle's end 53 to form the upper boundary 48 of the channel 49. At a position proximate the intersection 52 of the chamfered surfaces 39 and the upper surface of the handle 37, the upper boundary 48 of the channel 49 steps up, decreasing the thickness 59 of the handle as illustrated in FIG. 6.

The cooperation of all of these elements is shown in FIGS. 4, 8, 10, 11 and 12. The perspective view shown in FIG. 4 illustrates the tool of this particularly preferred embodiment in operation. This position is intermediate in the steps required to open a flip-top beverage can. FIG. 4 shows one of the advanatages of the instant invention. The blade 35 is inserted through the ring 9 of the flip top structure. This enables the user to apply sufficient leverage to force the displaceable disc 7 downward without separating the flip top ring 9 from the raised connection 16. The cross-sectional view shown in FIG. 8 reveals how the force on the raised connection 16 is reduced. As the handle 37 is moved upward, the flip top ring 9 is supported by the chamfered surfaces 39. The rotation of the flip top ring 9 is facilitated by the chamfered surfaces 39 which allow the flip top ring to slide up the handle.

Figure 8:
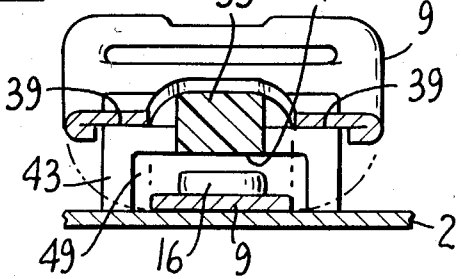
FIG. 8 is a cross-sectional view taken along the line 8—8 in FIG. 4.

The cooperation of the downwardly projecting rails 43 is shown in the cross-sectional view of FIG. 8. The channel 49 formed by the rails 43 and the lower surface of the blade 47 guides the tool to this intermediate position. The blade 35 is positioned above the raised connection 16 so that it can extend the greatest distance over the displaceable disc 7. This position also permits the flip top ring 9 to rotate up and away from the beverage can surface 2 when the tools is rotated up and away.

Figure 11:
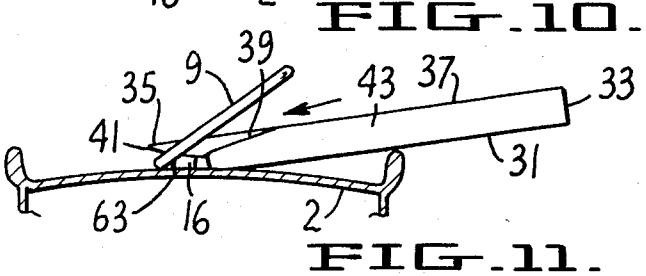
FIG. 11 is a perspective view of the tool in a subsequent step.
Figure 12:
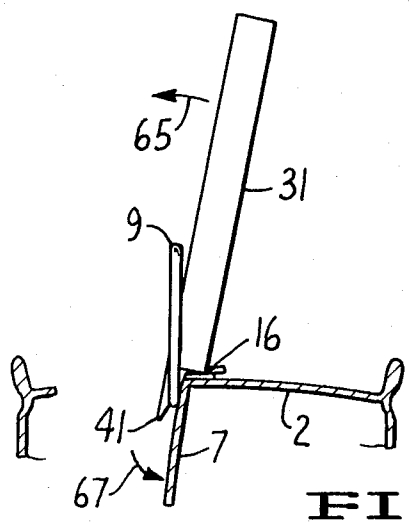
FIG. 12 is a perspective view of the tool in the final position.

The sequence of positions of the tool in use is shown by FIGS. 10, 11 and 12. At the start positions shown in FIG. 10 the blade 35 is inserted between the beverage can surface 2 and the flip top ring 9. The lower surface of the rails 43 rests on the lip 61 of the beverage can 3, allowing the user to apply some leverage to force the flip top ring 9 up and away from the beverage can surface 2. Once the flip top ring 9 has been raised slightly above the beverage can surface 2, the downwardly projecting rails guide the tool towards the displaceable disc 7 over the raised connection 16 as seen in FIG. 11. The chamfered surfaces 39 minimize the force on the raised connection 16 by reducing the angle 63 at which the tool 31 meets the flip top ring 9. FIG. 11 also shows the blade inserted into the ring 9 of the flip top structure so that the ring 9 surrounds the blade 35. This means that the force applied to open the can will be distributed between the blade 35 and the ring 9. The final position of the tool in operation is shown in FIG. 12. To get from the position shown in FIG. 11 to that of FIG. 12, the handle 37 has been rotated in a counter-clockwise direction as suggested by the arrows 65 and 67. The flip-top ring 9 and the tool 31 have been rotated about the raised connection 16 to force the displaceable disc 7 down and into the beverage can 3. The applied force required to displace the disc 7 was distributed between the blade edge 41 and the flip-top ring 9. After the beverage can has been opened, the tool can be removed and the flip-top ring 9 returned to its original horizontal position resting upon the beverage can surface 2.

Although, in this preferred embodiment the rails 43 run the full length of the handle 37, this is a result of the injection molding manufacturing process by which the tool 31 is made. To practice this invention it is necessary that the rails 43 extend back along the handle only part of the way.

While the subject invention has been described with reference to a preferred embodiment, it will be apparent that other changes and modifications could be made by one skilled in the art, without varying from the scope or spirit of the claims appended hereto.

I claim:

1. A tool for opening flip-top cans of the type having a combination ring and displaceable disc structure which comprises:

an elongated handle, with one end thereof having two opposed, downwardly projecting rails, said rails extending from said one end along the length of said handle to a point intermediate the length thereof, said tool further including a blade projecting outwardly from said one end substantially along the axis of said elongated handle, with the lower surface of said blade being above the plane defined by the lower surface of the downwardly projecting rails, whereby in use, said blade is inserted through the ring of said flip-top structure with said rails functioning to guide said blade to and over said displaceable disc whereupon said tool is rotated upwardly in a manner to lift said ring and push said displaceable disc downwardly into said can.

2. The tool of claim 1 wherein said downwardly projecting rails are substantially parallel and cooperate to form a channel for guiding the blade to the displaceable disc.

3. The tool of claim 1 wherein the connection of the ring to the can includes a raised portion and wherein the width of said channel is determined by the size of said raised portion.

4. The tool of claim 1 wherein the channel is substantially three eighths inches wide.

5. The tool of claim 1 wherein the upper surface of said elongated handle, adjacent said one end, includes a pair of opposed chamfered surfaces such that during use, the upward rotation of said ring of said flip-top structure is facilitated.

6. The tool of claim 5 wherein said chamfered surfaces are inclined to the upper surface of said elongated handle at an angle of substantially ten degrees.

7. The tool of claim 1 wherein said downwardly projecting rails extend the full length of said elongated handle.

8. The tool of claim 1 wherein the upper surface of said elongated handle is substantially coplanar with the upper surface of said outwardly projecting blade.

9. The tool of claim 1 wherein said blade projects outwardly from said one end of said elongated handle a distance of substantially three eighths inches.

10. The tool of claim 1 wherein the blade has a sharp edge at its distal end.

11. The tool of claim 10 wherein said sharp edge is formed by the oblique positioning of the lower surface of said blade and the upper surface of said blade.

* * * * *